US010034583B2

(12) United States Patent
Carignan et al.

(10) Patent No.: US 10,034,583 B2
(45) Date of Patent: Jul. 31, 2018

(54) DISPENSER WITH STROKE ADJUSTMENT CAPABILITIES

(71) Applicant: GPCP IP HOLDINGS LLC, Atlanta, GA (US)

(72) Inventors: Ryan David Carignan, Oshkosh, WI (US); Jacob Charles Dahl, Menasha, WI (US)

(73) Assignee: GPCP IP HOLDINGS LLC, Atlanta, GA (US)

( * ) Notice: Subject to any disclaimer, the term of this patent is extended or adjusted under 35 U.S.C. 154(b) by 111 days.

(21) Appl. No.: 15/061,307

(22) Filed: Mar. 4, 2016

(65) Prior Publication Data

US 2017/0251884 A1 Sep. 7, 2017

(51) Int. Cl.
*A47K 5/12* (2006.01)
*B05B 11/00* (2006.01)

(52) U.S. Cl.
CPC ..... *A47K 5/1202* (2013.01); *A47K 5/1217* (2013.01); *B05B 11/0054* (2013.01);
(Continued)

(58) Field of Classification Search
CPC ..... A47K 5/1202; A47K 5/1271; B05B 11/0054; B05B 11/3042; B05B 11/3005; B05B 11/3007–11/3008
(Continued)

(56) References Cited

U.S. PATENT DOCUMENTS 3,097,763 A 7/1963 Aluotto
3,458,090 A * 7/1969 Scoggin, Jr. ..... G01F 11/06 222/309

(Continued)

FOREIGN PATENT DOCUMENTS

CA 1088474 10/1980
CA 2296115 10/1999

OTHER PUBLICATIONS

"Window Cling Gallery", retrieved from <http://www.gojo.com/en/Dispenser-Customization/Window-Cling-Gallery>, last accessed Jul. 13, 2016.

(Continued)

*Primary Examiner* — Nicholas J Weiss
*Assistant Examiner* — Andrew P Bainbridge
(74) *Attorney, Agent, or Firm* — Nelson Mullins Riley & Scarborough-Georgia Pacific

(57) ABSTRACT

A stroke adjuster and an associated dispenser are provided. An example embodiment provides a dispenser configured to dispense a fluid or foam and comprising a housing and a stroke adjuster. The housing comprises at least one housing engagement surface and defines an adjuster receiving area. The adjuster receiving area is configured to receive the stroke adjuster in one of either a first orientation or a second orientation. When the stroke adjuster is oriented within the dispenser in the first orientation a first surface is oriented upward and, when the dispenser is activated, a lower pump engagement surface of the pump is engaged by the first surface of the stroke adjuster. When the stroke adjuster is oriented within the dispenser in the second position a second surface is oriented upward and, when the dispenser is activated, the lower pump engagement surface is engaged by the housing engagement surface.

22 Claims, 10 Drawing Sheets

(52) U.S. Cl.
CPC ..... *B05B 11/3042* (2013.01); *B05B 11/3005* (2013.01); *B05B 11/3007* (2013.01); *B05B 11/3008* (2013.01)

(58) Field of Classification Search
USPC ..... 222/309, 282, 333, 190
See application file for complete search history.

(56) References Cited

U.S. PATENT DOCUMENTS 4,084,729 A * 4/1978 Epple ..... G01F 11/025 222/307
4,238,056 A 12/1980 Tucker et al.
4,330,071 A 5/1982 Ohlson
4,936,492 A 6/1990 Amiel et al.
4,974,753 A 12/1990 Tucker et al.
5,033,657 A * 7/1991 Whittington ..... A47K 5/1202 222/181.2
5,271,530 A 12/1993 Uehira et al.
5,348,189 A 9/1994 Cater
5,445,288 A 8/1995 Banks
5,465,877 A 11/1995 Bell et al.
5,676,277 A 10/1997 Ophardt
5,839,617 A 11/1998 Cater et al.
6,082,586 A 7/2000 Banks
6,390,338 B1 5/2002 Baudin
6,409,050 B1 6/2002 Ophardt et al.
6,601,736 B2 8/2003 Ophardt et al.
6,607,103 B2 * 8/2003 Gerenraich ..... A47K 5/1217 222/183
6,619,513 B2 9/2003 Baudin
6,814,236 B2 11/2004 Roshdy
6,820,586 B2 11/2004 Watanabe
6,966,463 B1 11/2005 Yeager et al.
7,004,356 B1 2/2006 Kafner
7,156,353 B2 1/2007 Kringel et al.
7,303,099 B2 12/2007 Ophardt
RE40,319 E 5/2008 Ophardt et al.
7,461,762 B2 12/2008 Law et al.
7,641,077 B2 1/2010 Law et al.
8,091,739 B2 1/2012 Ophardt et al.
8,113,388 B2 * 2/2012 Ophardt ..... A47K 5/1207 222/181.3
8,261,950 B2 9/2012 Cittadino et al.
8,272,539 B2 9/2012 Ophardt et al.
8,272,540 B2 9/2012 Ophardt et al.
8,313,008 B2 11/2012 Ciavarella et al.
8,360,286 B2 1/2013 Shi et al.
8,499,982 B2 8/2013 Ray
8,579,159 B2 11/2013 Ciavarella
8,590,751 B2 11/2013 Ciavarella et al.
8,746,510 B2 6/2014 Cittadino et al.
8,763,863 B2 7/2014 Quinlan et al.
8,783,511 B2 7/2014 Snodgrass
8,827,120 B2 9/2014 Boshuizen et al.
8,851,331 B2 * 10/2014 Pelkey ..... A47K 5/1202 222/181.3
9,340,337 B2 * 5/2016 Pelkey ..... B65D 55/10
2004/0232168 A1 * 11/2004 Ciavarella ..... A47K 5/1202 222/156
2005/0072805 A1 4/2005 Matthews
2005/0072808 A1 * 4/2005 Kitamura ..... B05B 11/3001 222/309
2008/0121663 A1 * 5/2008 Ophardt ..... B05B 11/00 222/309
2009/0032552 A1 2/2009 Ophardt et al.
2009/0101671 A1 4/2009 Cittadino et al.
2009/0145296 A1 6/2009 Ophardt et al.
2009/0294476 A1 12/2009 Koenig et al.
2009/0294478 A1 12/2009 Ciavarella et al.
2010/0051640 A1 * 3/2010 Chen ..... A47K 5/1209 222/52
2010/0059550 A1 3/2010 Ciavarella et al.
2010/0096412 A1 4/2010 Law et al.
2010/0140297 A1 6/2010 Ophardt et al.
2011/0101032 A1 * 5/2011 Hsu ..... A47K 5/1202 222/309
2012/0080452 A1 * 4/2012 Boshuizen ..... G01F 11/00 222/181.3
2012/0091169 A1 * 4/2012 Lashells ..... B05B 11/3005 222/309
2012/0111885 A1 5/2012 Binderbauer et al.
2012/0298698 A1 * 11/2012 Lee ..... G01F 11/023 222/309
2012/0308405 A1 12/2012 McNulty et al.
2013/0292410 A1 11/2013 Pelkey et al.
2014/0131383 A1 5/2014 Crossdale et al.
2014/0209638 A1 7/2014 Ciavarella et al.
2015/0173568 A1 6/2015 Harris et al.

OTHER PUBLICATIONS

"GP EnMotion® Splash Blue Automated Touchless Soap & Sanitizer Dispenser." retrieved from <http://catalog.gppro.com/catalog/11268/16642?filter=full>; last accessed Jul. 13, 2016.
"GP Georgia-Pacific® Splash Blue Manual Soap and Sanitizer Dispenser." retrieved from <http://catalog.gppro.com/catalog/6445/16643?filter=full>; last accessed Jul. 13, 2016.
"GP EnMotion® Dye & Fragrance Free E3 Rated Gel Hand Sanitizer 950 ML" retrieved from <http://catalog.gppro.com/catalog/11268/21790?filter=full>; last accessed Jul. 13, 2016.

* cited by examiner

DISPENSER WITH STROKE ADJUSTMENT CAPABILITIES

BACKGROUND

Soap dispensers are generally provided in bathrooms, on work sites, and other locations for providing soap (foam, liquid, or gel) to a user for hand washing. Depending on the expected level or type of soil on a user's hands at particular location, a building manager, janitor or the like may wish to set the dispenser to provide more or less soap to a user. For example, it may be preferred that a soap dispenser in a public restroom provide a particular amount of soap and that a soap dispenser in a healthcare setting or at an automobile shop provide a larger amount of soap at each dispense. In this regard, it is beneficial to provide an ability to adjust the amount of soap provided to the user for each dispense.

Therefore, there is a need in the art for dispensers (e.g., soap dispensers) for which the amount of fluid or foam provided to a user for each dispense may be adjusted.

BRIEF SUMMARY

In various embodiments, a stroke adjuster is provided for adjusting the amount of fluid or foam (e.g., soap) provided to a user from a dispenser at each activation of the dispenser. In various embodiments, a dispenser comprising a stroke adjuster is provided. In various embodiments, such a dispenser may be operated with or without the stroke adjuster positioned within the dispenser. In such embodiments, the dispenser is still operable even if the stroke adjuster has been misplaced or removed from the dispenser for any reason.

According to one aspect of the present invention, a dispenser configured to dispense a fluid or foam is provided. In an example embodiment, the dispenser comprises a housing configured for receiving therein a fluid reservoir and a pump configured to dispense the fluid or foam from the reservoir. The housing comprises at least one housing engagement surface and defines an adjuster receiving area. The dispenser further comprises a stroke adjuster having a first surface and a second surface. The first surface defines a first plane and the second surface defines a second plane. The first plane is parallel or near parallel to the second plane. The adjuster receiving area is configured to receive the stroke adjuster in one of either a first orientation or a second orientation. When the stroke adjuster is oriented within the dispenser in the first orientation the first surface is oriented upward and, when the dispenser is activated, a lower pump engagement surface of the pump is engaged by the first surface of the stroke adjuster. When the stroke adjuster is oriented within the dispenser in the second position the second surface is oriented upward and, when the dispenser is activated, the lower pump engagement surface is engaged by the housing engagement surface.

According to another aspect of the present invention, a stroke adjuster is provided. In an example embodiment, the stroke adjuster comprises a first surface and a second surface. The first surface defines a first plane and the second surface defines a second plane. The first plane is parallel or near parallel to said second plane. The stroke adjuster is configured to be oriented within a dispenser in one of either a first orientation or a second orientation. When the stroke adjuster is oriented within the dispenser in the first orientation the first surface is positioned upward and, when the dispenser is activated, a lower pump engagement surface of a pump positioned within the dispenser is engaged by the first surface of the stroke adjuster. When the stroke adjuster is oriented within the dispenser in the second orientation the second surface is positioned upward and, when the dispenser is activated the lower pump engagement surface is not engaged by the stroke adjuster.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1 shows a perspective view of an example activation mechanism of a dispenser, in accordance with example embodiments of the present invention;

FIGS. 2, 2B, 2C, and 2D show a perspective view, a top view, a side view, and a front view, respectively, of a stroke adjuster, in accordance with example embodiments of the present invention;

FIG. 3 shows a cross-section of a stoke adjuster and a dispenser, wherein the stroke adjuster is positioned within the dispenser, in accordance with example embodiments of the present invention;

FIG. 4 provides a perspective view of a stroke adjuster oriented in a first orientation in a dispenser, in accordance with example embodiments of the present invention;

Figure 7:
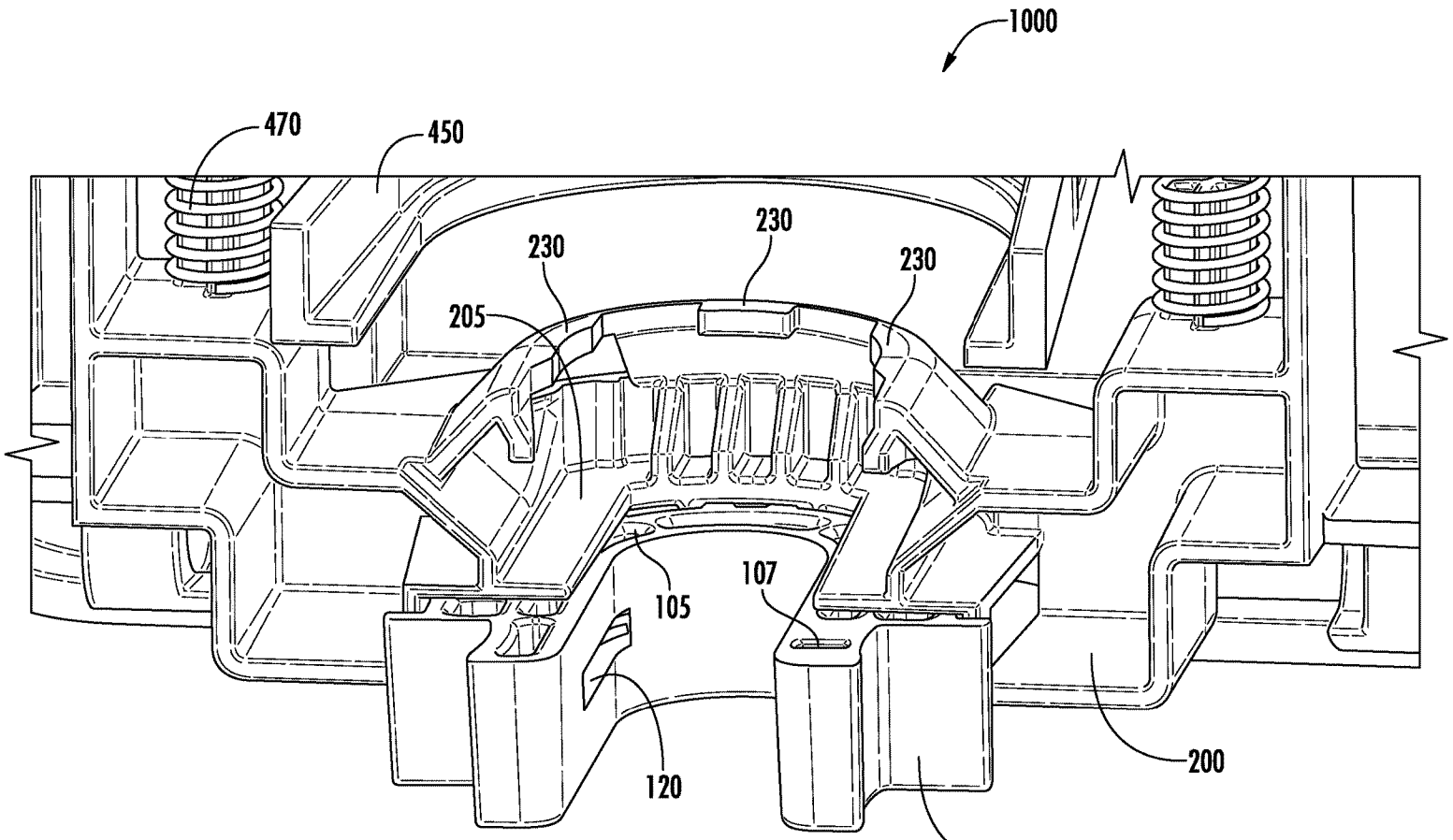
Figure 8:
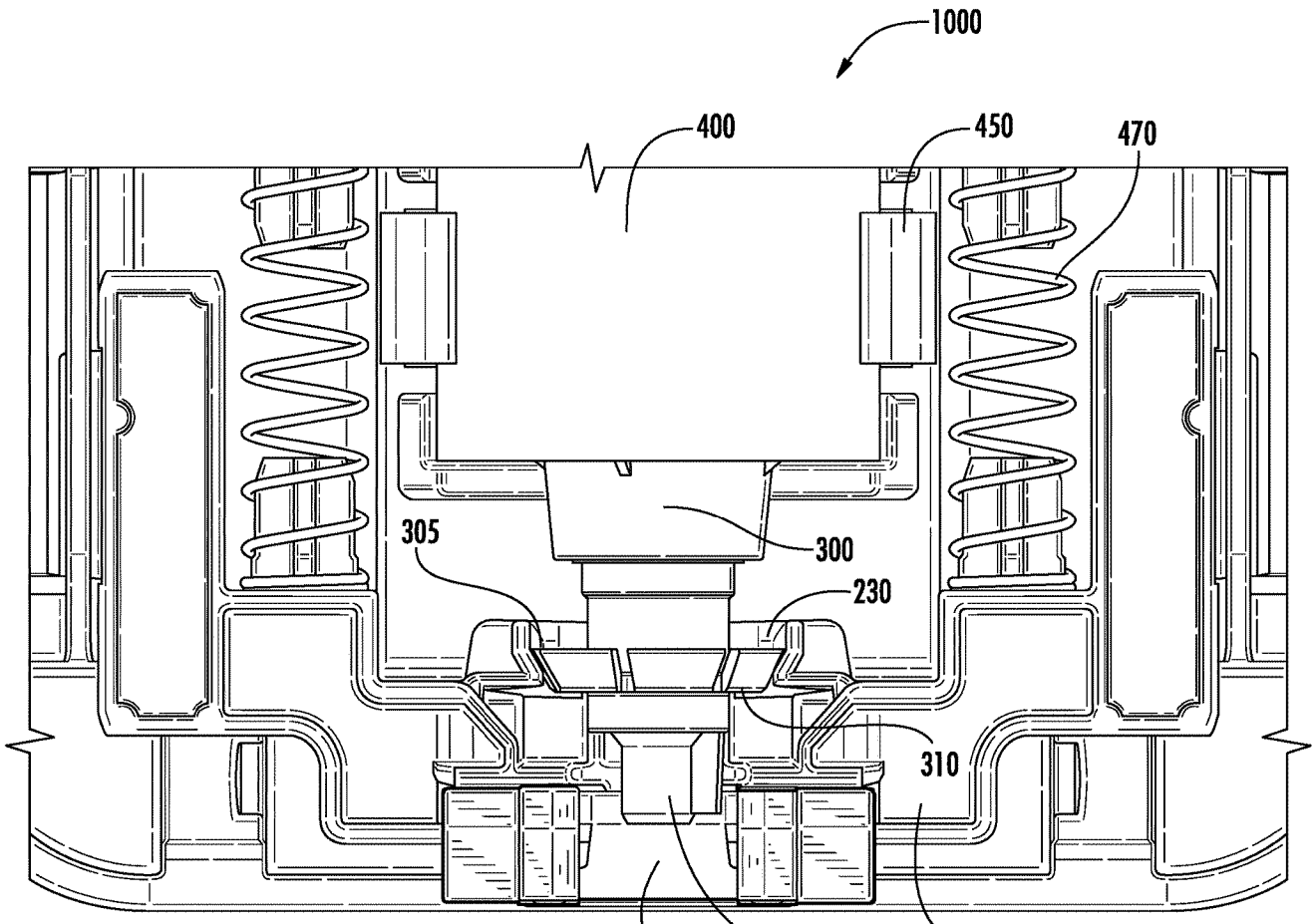
Figure 9:
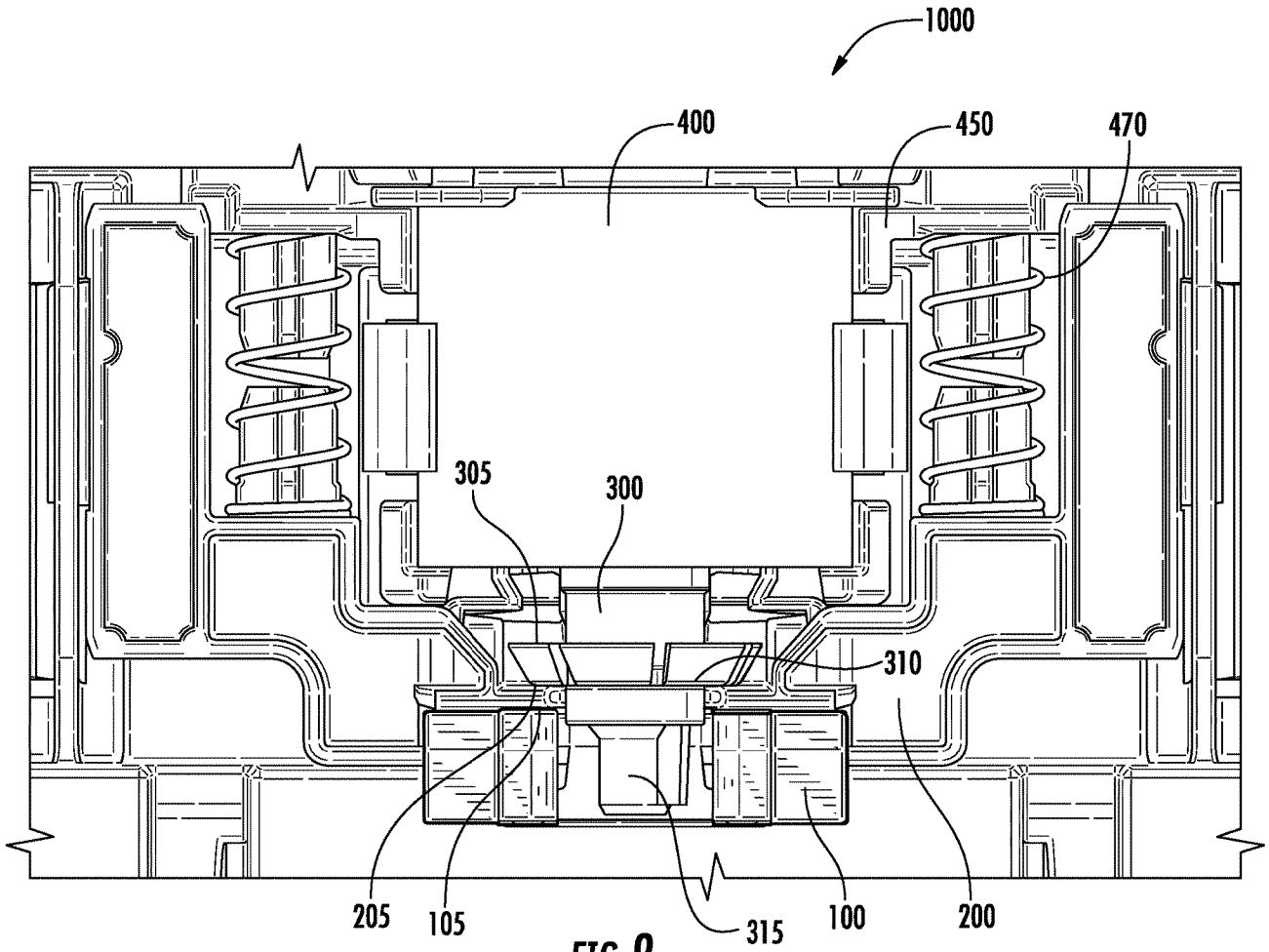

FIG. 7 provides a perspective view of a stroke adjuster oriented in a second orientation in a dispenser, in accordance with example embodiments of the present invention;

FIG. 8 shows a cross-section of an example dispenser having a stroke adjuster oriented therein in the second orientation, wherein a pump in the dispenser is at the starting point of a full pump stroke, in accordance with example embodiments of the present invention; and FIG. 9 shows a cross-section of the example dispenser of FIG. 8 with the stroke adjuster oriented therein in the second orientation, wherein the pump is at the ending point of a full pump stroke, in accordance with example embodiments of the present invention.

DETAILED DESCRIPTION OF VARIOUS EMBODIMENTS

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Exemplary Dispenser

Dispensers are often used to provide soap, hand sanitizer, and/or other fluids, liquids, or foams to a user that may be used, for example, for hand washing and/or sanitizing. In general, a fluid may be a substance that has no fixed shape and yields easily to external pressure. For example, a fluid may be a substance that flows easily. Some non-limiting examples of fluids are liquid soap, gel soap, and hand sanitizer.

Generally, a dispenser comprises a housing for receiving a replaceable fluid reservoir and pump configured to receive fluid from the fluid reservoir and provide fluid or foam to the user. The pump may be connected to the fluid reservoir such that when the fluid reservoir is empty or the supply of fluid in the fluid reservoir is low, the fluid reservoir and pump may be removed from the housing of the dispenser and replaced.

In general, the dispenser housing encloses the fluid reservoir such that only approved individuals may access the interior of the dispenser (including the fluid reservoir). For example, the dispenser housing may comprise a hinged door or removable panel that may be secured to prevent unauthorized access to the interior of the dispenser. For example, the hinged door or removable panel may be secured in a closed position with a key or other locking mechanism.

Figure 5:
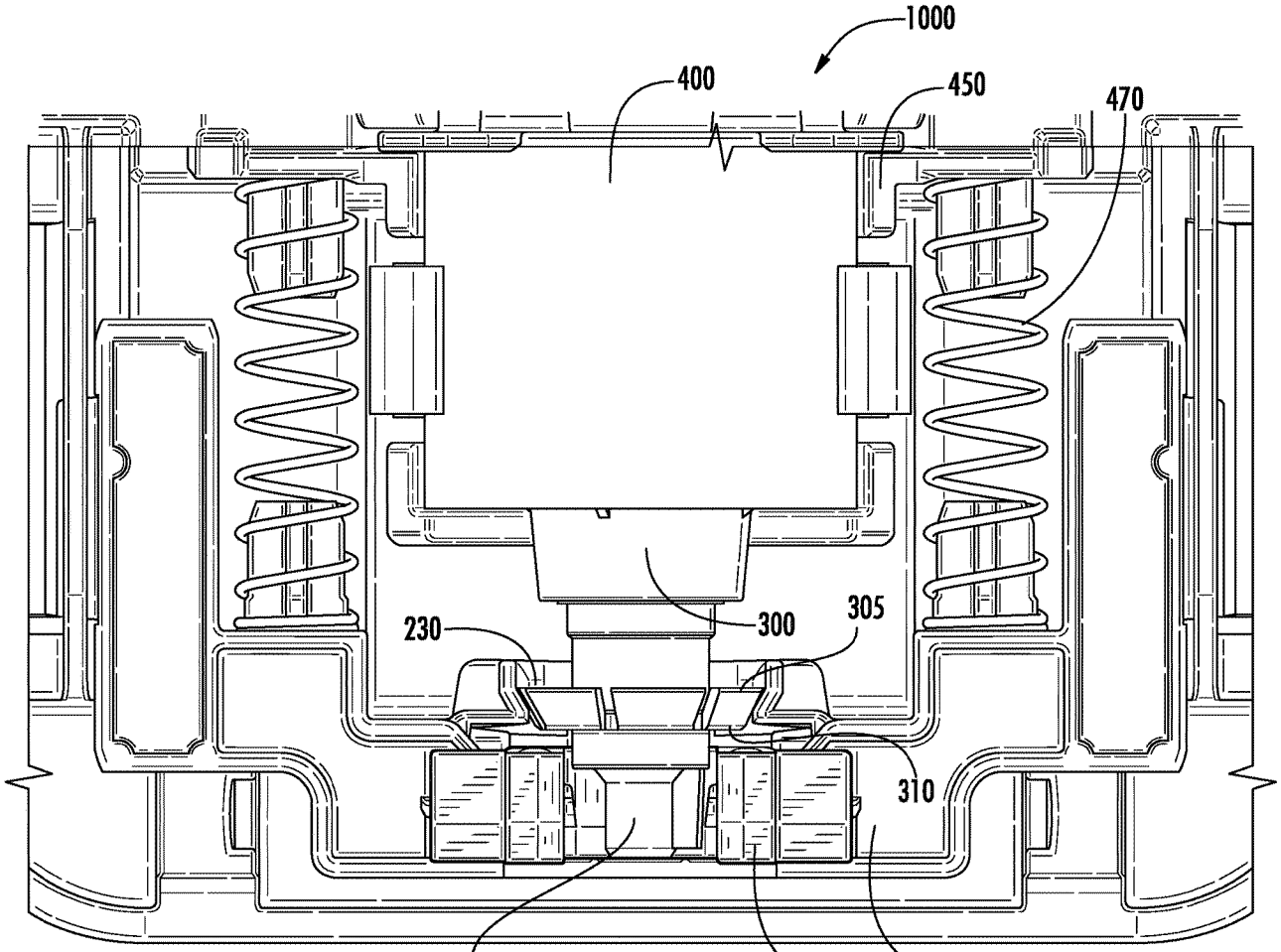
FIG. 5 shows a cross-section of an example dispenser having a stroke adjuster oriented therein in the first orientation, wherein a pump in the dispenser is at the starting position of a full pump stroke, in accordance with example embodiments of the present invention.

A dispenser also generally includes an activation mechanism. For example, a dispenser may comprise a button, lever, motion sensor, and/or the like that a user may press or otherwise interact with to activate the dispenser. For example, the user may wave his or her hands in the vicinity of a motion detector or may press a lever on the dispenser to cause the dispenser to provide fluid or foam to the user. When the dispenser is activated (e.g., when the button or lever is pressed or when the motion sensor detects a user's hand motion) a mechanism (e.g., gears, motor, etc.) within the dispenser causes the pump and fluid reservoir to move from a starting position to an ending position of the full pump stroke of the dispenser. For example, FIGS. 5 and 8 show a cross-section of a dispenser 1000 having a fluid reservoir 400 and a pump 300 positioned within a pump housing 450 where the pump 300 is at the starting point of the full pump stroke.

Figure 1:
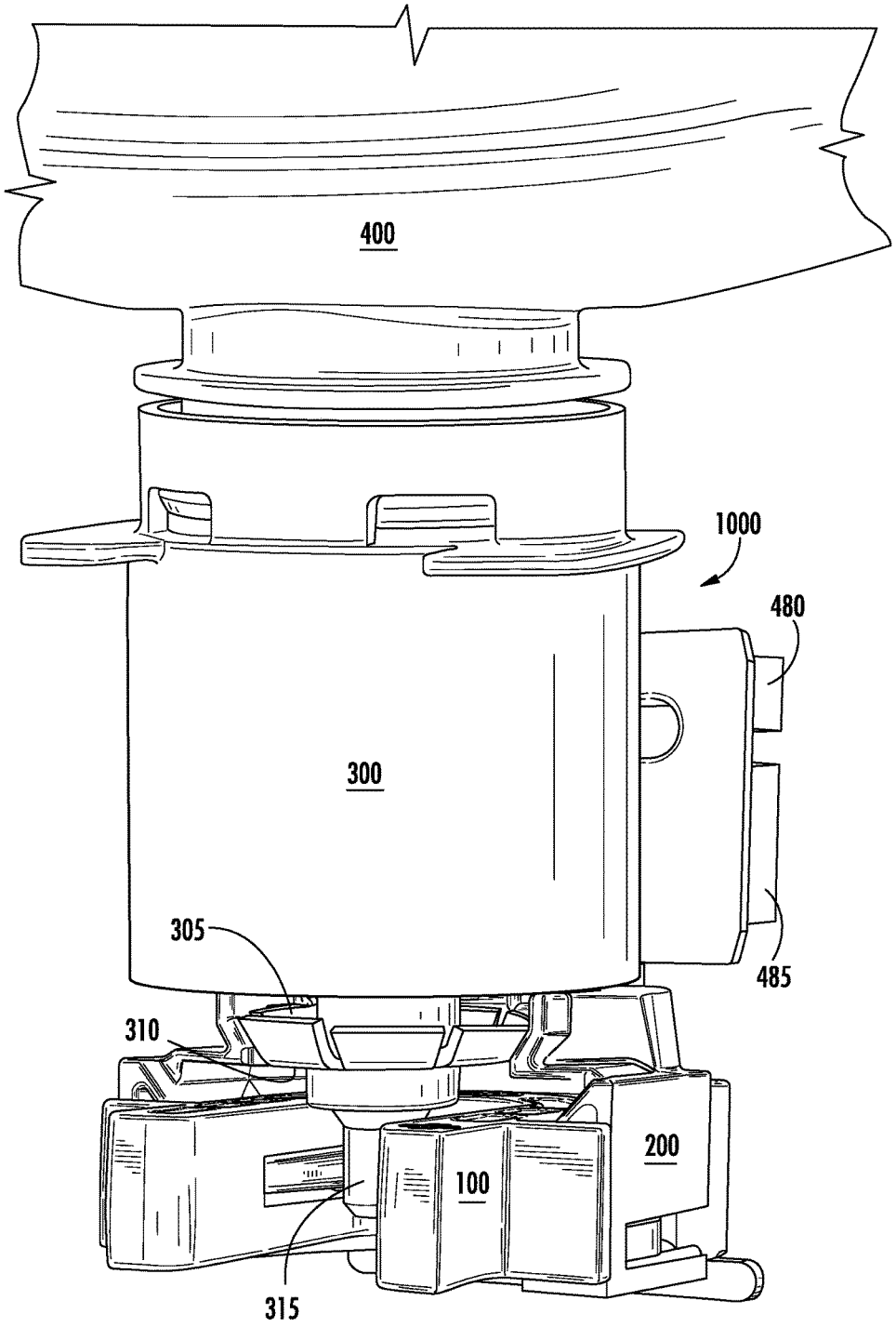
Figure 2:
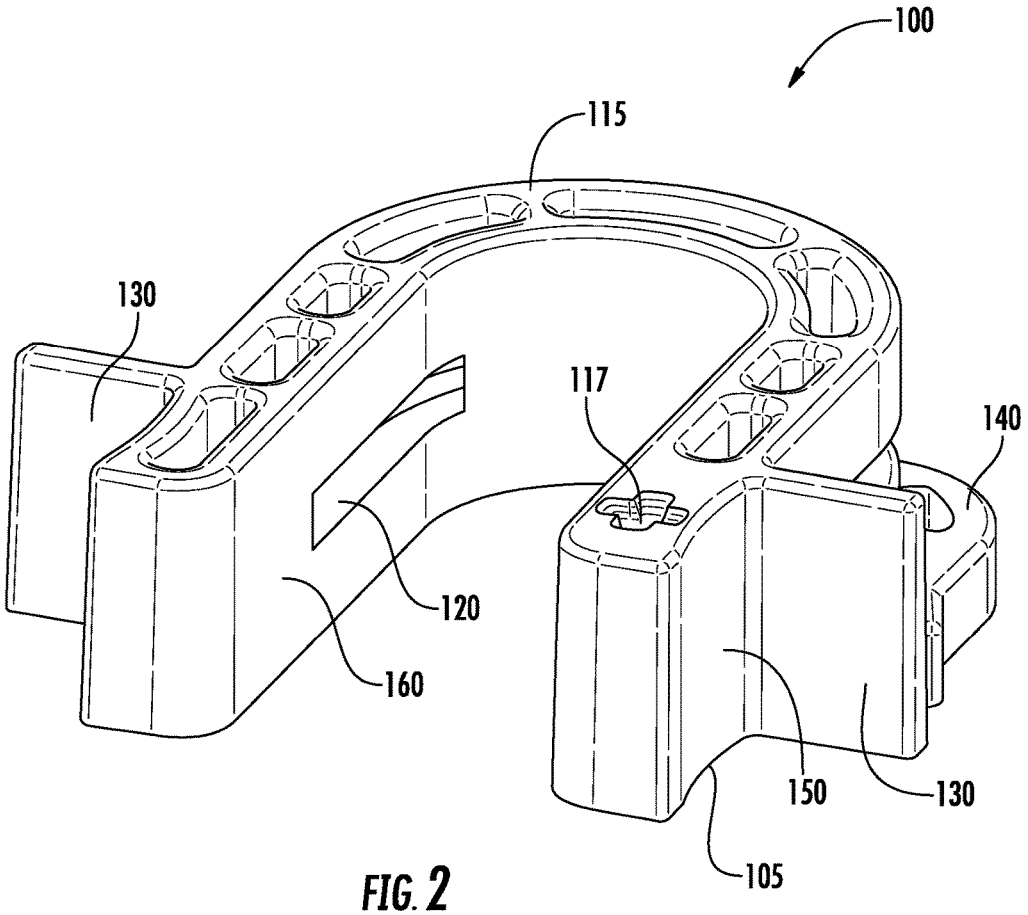
Figure 2C:
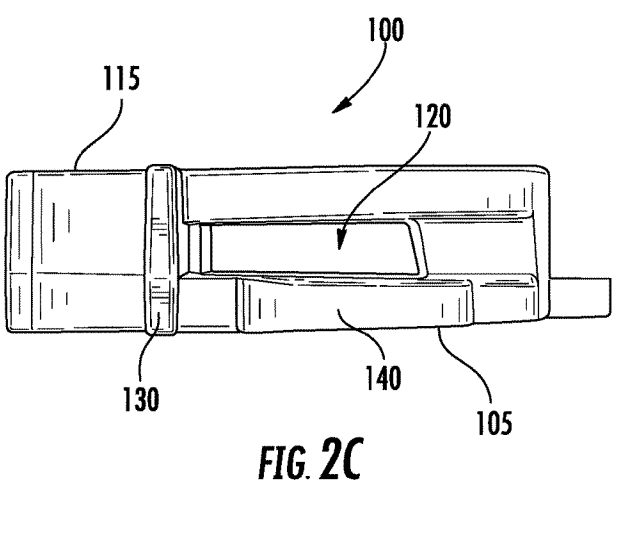
Figure 2B:
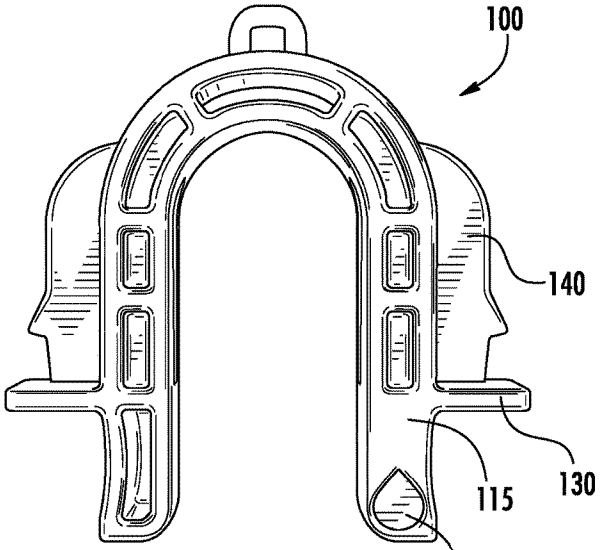
Figure 2D:
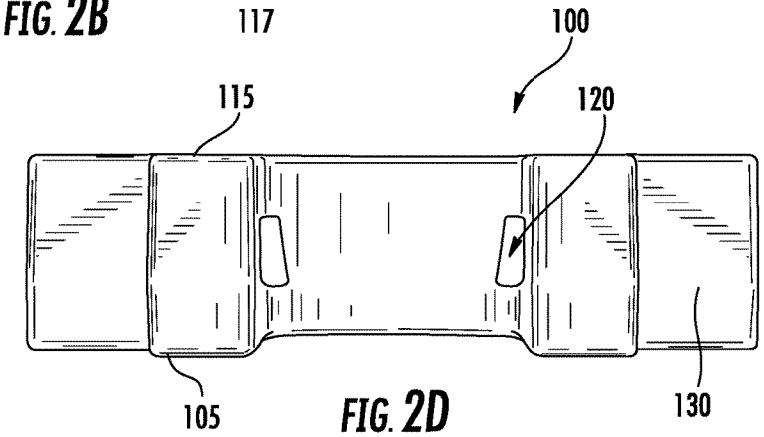
Figure 4:
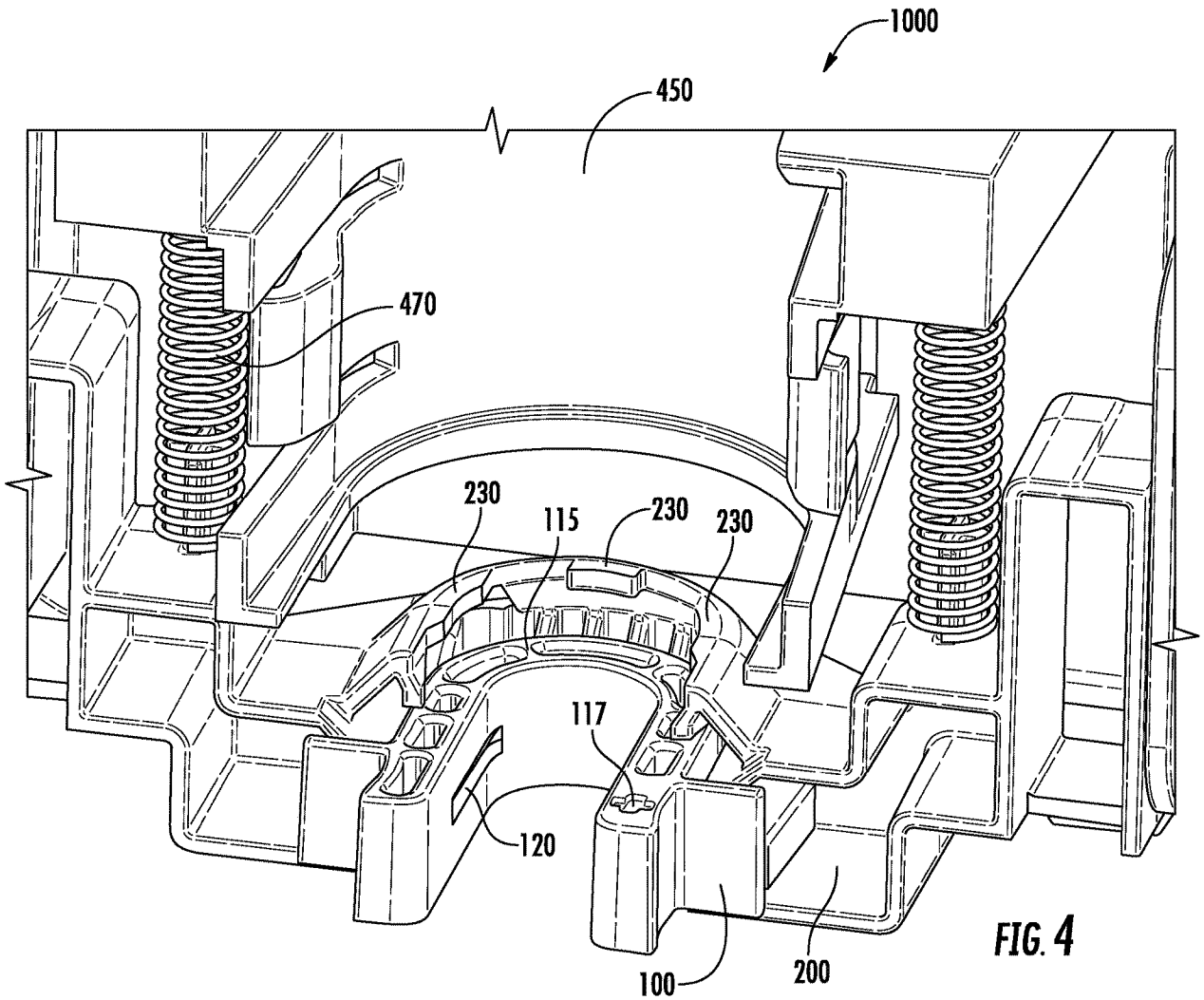
Figure 6:
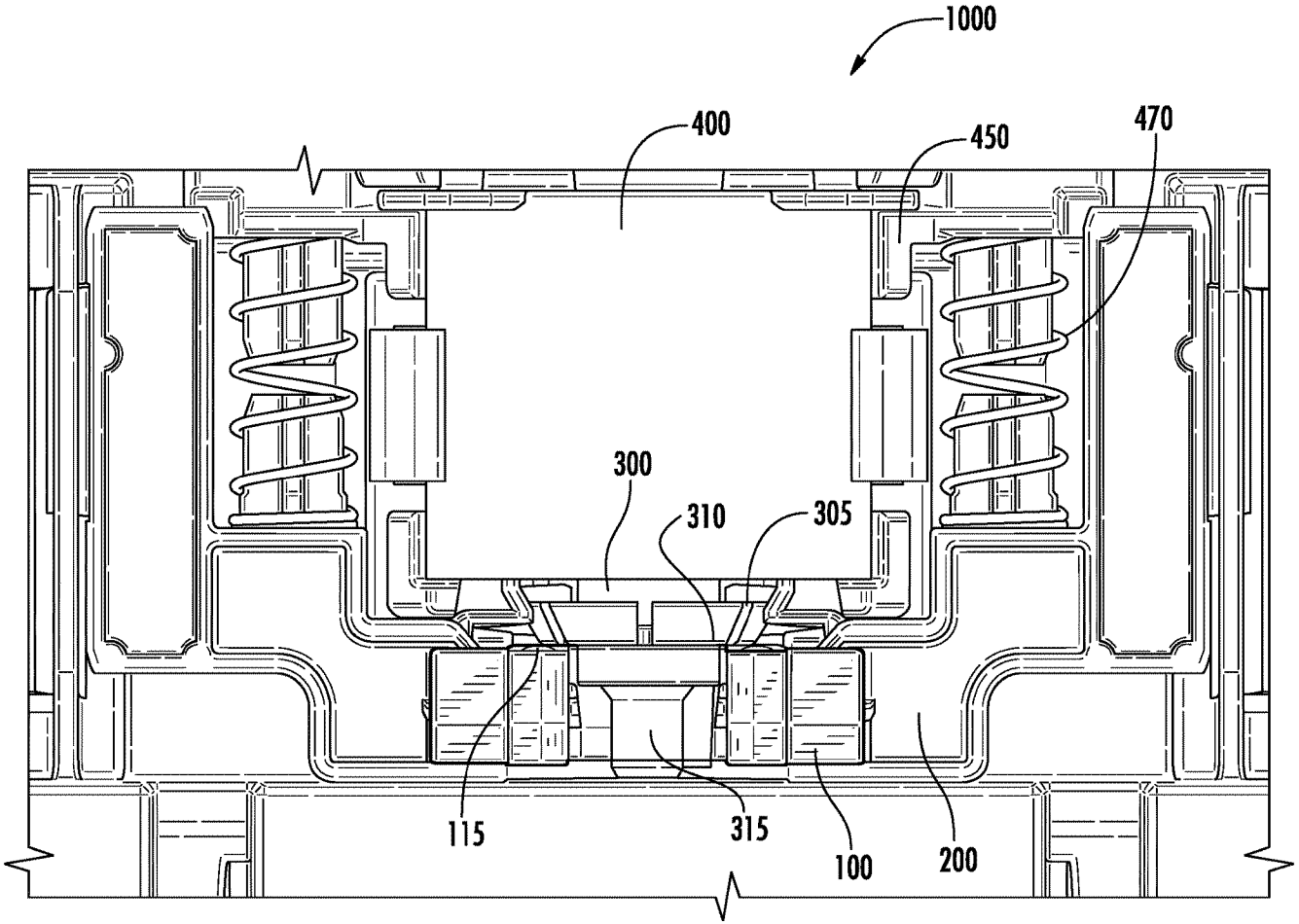
FIG. 6 shows a cross-section of the example dispenser of FIG. 5 with the stroke adjuster oriented therein in the first orientation, wherein the pump is at the ending point of a full pump stroke, in accordance with example embodiments of the present invention.

FIG. 1 illustrates a portion of a dispenser 1000 including the activation mechanism for activating the dispenser and causing fluid and/or foam to be dispensed from the dispenser. The example activation shown in FIG. 1 is an automatic activation mechanism that is configured to be activated by a user activating a motion sensor (not shown). When the motion sensor detects the movement of a user's hand(s), for example a signal may be sent to a control board within the dispenser. The control board may process the signal, and cause a motor and gear assembly 485 to be activated. The motor and gear assembly 485 may comprise one or more motors and one or more gears configured to cause the housing 200 (and the stroke adjuster 100 positioned therein) to move upward to dispense fluid and/or foam from the dispenser and to move downward to prime the pump 300 for the next activation of the dispenser. The motor may be powered by a battery or set of batteries 480 and/or other power supply (e.g., connection to line voltage). When the motor and gear assembly 485 is activated, the motor causes the gears to rotate which in turn causes the housing 200 to move upward from the starting point of the full pump stroke. As the housing 200 moves upward, the stroke adjuster 100 positioned within the housing 200 also moves upward. As the stroke adjuster 100 and housing 200 move upward, eventually either the first engagement surface 115 or the housing engagement surface 205 (depending on whether the stroke adjuster is oriented within the dispenser 1000 in the first orientation/position or the second orientation/position as described below and as shown in FIGS. 4 and 7) engages the lower engagement surface 310 of the pump 300. Thus, at a point between the starting point of the full pump stroke and the ending point of the full pump stroke, the first engagement surface 115 or the housing engagement surface 205 engages the lower engagement surface 310 of the pump 300, as shown in FIGS. 6 and 9.

The engagement of the lower engagement surface 310 by the first engagement surface 115 or the housing engagement surface 205 causes a compression of the pump 300 as the housing 200 and the stroke adjuster 100 continue to move upward. In particular, the engagement of the lower engagement surface 310 of the pump 300 causes an inner piston of the pump 300 to be pushed upward within an outer piston of the pump 300 as the housing 200 and the stroke adjuster 100 continue to move upward. Thus, the inner piston of the pump is forced upward through an outer piston of the pump, causing a compression of the pump 300 and causing fluid and/or foam to be dispensed from the pump and provided to the user. The point at which the lower pump engagement surface 310 is engaged by the other engagement surface (e.g., 115, 205) and begins to force the inner piston upward is the starting point of the meaningful pump stroke. The inner piston of the pump continues upward until reaching the ending point of the full pump stroke, which is also the ending point of the meaningful pump stroke. Thus, the length of the meaningful pump stroke defines how much of the fluid or foam in the pump 300 is provided to the user.

After the fluid and/or foam is provided to the user (e.g., after the ending point of the meaningful pump stroke and the ending point of the full pump stroke is reached), the motor and gear assembly 485 may cause the housing 200 and stroke adjuster 100 to return to the initial position (e.g., the starting point of the full pump stroke). The pump 300 also returns to the initial position. In particular, the dispenser flanges 230 engage the upper engagement surface 305 of the pump 300 and cause the nozzle 315 to move downward to return to the starting point of the full pump stroke (see FIGS. 5 and 8). As the inner piston of the pump 300 is pulled downward and out of the outer piston of the pump, fluid from the fluid reservoir may be pulled into the pump 300 and thereby the pump 300 may be primed for the next activation. Thus, the action of returning the housing 200 to the starting point of the full pump stroke causes the pump 300 to be primed for the next activation of the dispenser.

In various embodiments, when a new and/or refilled fluid reservoir 400 and pump 300 are positioned within the dispenser 1000 (e.g., by a janitor or the like), the dispenser 1000 may need to be activated once, two to four times, and/or the like, to prime the pump 300. For example, in various embodiments, the janitor or maintainer of a dispenser 1000 may position a new and/or refilled fluid reservoir 400 and pump 300 within the dispenser 1000. The janitor or maintainer may then activate the dispenser by activating the motion sensor one or more times, for example. This initial priming activation may ensure that the upper pump engagement surface 305 is adjacent the dispenser flanges 230, that the pump 300 is primed, and/or the like.

As noted above, in various embodiments, the dispenser 1000 may be activated by a user pressing a button or lever, or activating some other sensor (e.g., the user may wear an RFID transmitter and the dispenser may comprise an RFID receiver configured to activate the dispenser upon receiving an RFID signal). In such example embodiments, when the user causes the dispenser to be activated, a motor and gear assembly, a lever assembly, and/or other mechanism may cause the housing 200 to move upward. The interaction between the housing 200 and/or stroke adjuster 100 and the pump 300 is similar as that described above. Once the fluid has been dispensed and the ending point of the full pump stroke has been reached, one or more motors, springs (e.g., springs 470 shown in FIG. 4), or other mechanism may cause the housing 200 to move downward to the starting point of the full pump stroke. The nozzle 315 is moved downward to the starting point of the full pump stroke by engagement of the upper engagement surface 305 of the pump 300 and the dispenser flanges 230 as described above.

Embodiments of the present invention provide a dispenser comprising a stroke adjuster 100, shown in FIGS. 2, 2B, 2C, and 2D. For example, the dispenser housing 200 may be configured to receive the stroke adjuster 100 in either a first orientation/position or a second orientation/position. The stroke adjuster 100 is configured to adjust the length of the meaningful pump stroke to adjust the amount of fluid or foam provided to a user upon the activation of the dispenser. In various embodiments, the stroke adjuster is configured to adjust the length of the meaningful pump stroke without affecting the length of the full pump stroke. For example, each time the pump is primed, the pump is primed with the same amount of fluid or foam regardless of the orientation/position of the stroke adjuster 100 within the dispenser 1000. However, the percentage of the fluid or foam in the pump that is provided to the user upon activation of the dispenser 1000 is adjusted based on the orientation/position of the stroke adjuster 100. Moreover, the dispenser housing 200 may be configured such that if the stroke adjuster 100 is not positioned within the dispenser housing, the dispenser 1000 may still provide fluid or foam to a user upon activation of the dispenser.

Exemplary Stroke Adjuster

With reference to FIGS. 2, 2B, 2C, and 2D a stroke adjuster 100 defines a first surface 115 and an opposite second surface 105. In this regard, the stroke adjuster 100 can be flipped over such that the second surface 105 faces upwardly (as opposed to the orientation shown in FIG. 2).

The stroke adjuster 100 is configured to be received within a dispenser housing 200 of a dispenser 1000. For example, the stroke adjuster 100 can be received within the dispenser housing 200 in either a first orientation/position (as shown in FIG. 4) or a second orientation/position (as shown in FIG. 7). In this regard, the stroke adjuster 100 includes a dispenser engagement protrusion 140 (shown in FIG. 2) that is configured to fit within a corresponding slot or adjuster receiving area 240 (shown in FIG. 3) in the dispenser housing 200 in either the first orientation/position or second orientation/position. Additionally, as shown in FIG. 3, the stroke adjuster 100 includes slots or cut-out portions 120 on either side that are designed to receive a portion of the housing 200 when in the first orientation/position.

As shown in FIGS. 4-9, the dispenser 1000 comprises a pump housing 450 configured to receive a pump 300 and a fluid reservoir 400 therein. As shown in FIGS. 5 and 8, the pump 300 comprises a pump nozzle 315. The pump further comprises upper pump engagement surface(s) 305 and lower pump engagement position surface(s) 310. Generally, the upper pump engagement surface(s) 305 and the lower pump engagement surface(s) 310 are positioned between the pump nozzle 315 and the fluid reservoir 400, with the upper pump engagement surface(s) 305 positioned closer to the fluid reservoir 400 than the lower pump engagement surface(s) 310. The upper pump engagement surface 305 engages with the dispenser flanges 230 of the dispenser housing 200. In particular, during normal operation of the dispenser, an upper pump engagement surface 305 may engage the dispenser flanges 230 such that the pump nozzle 315, the upper engagement surface 305, and a lower pump engagement surface 310 remain below the dispenser flanges 230. Thus, at the starting point of the full pump stroke, the upper pump engagement surface 305 may be adjacent the dispenser flanges 230. In this regard, when a user activates the dispenser, the dispenser pushes the housing 200 upwardly from a starting point to an ending point of the full pump stroke. As the housing 200 and the stroke adjuster 100 move upward, the first engagement surface 115 or the housing engagement surface 205 may engage the lower pump engagement surface 310 of the pump nozzle to cause an inner piston of the pump 300 to be force upward into an outer piston of the pump. Thus, the engagement of the lower pump engagement surface 310 by the first engagement surface 115 or the housing engagement surface 205 begins the meaningful pump stroke (which is a portion of the full pump stroke and defines the amount of fluid or foam to be dispensed). In this regard, the housing 200 and the stroke adjuster 100 continue upwardly, causing the pump 300 to compress. The portion of the full pump stroke occurring after the engagement of the lower pump engagement surface 310 with another engagement surface (e.g., 115, 205) defines the length of the meaningful pump stroke.

Figure 3:
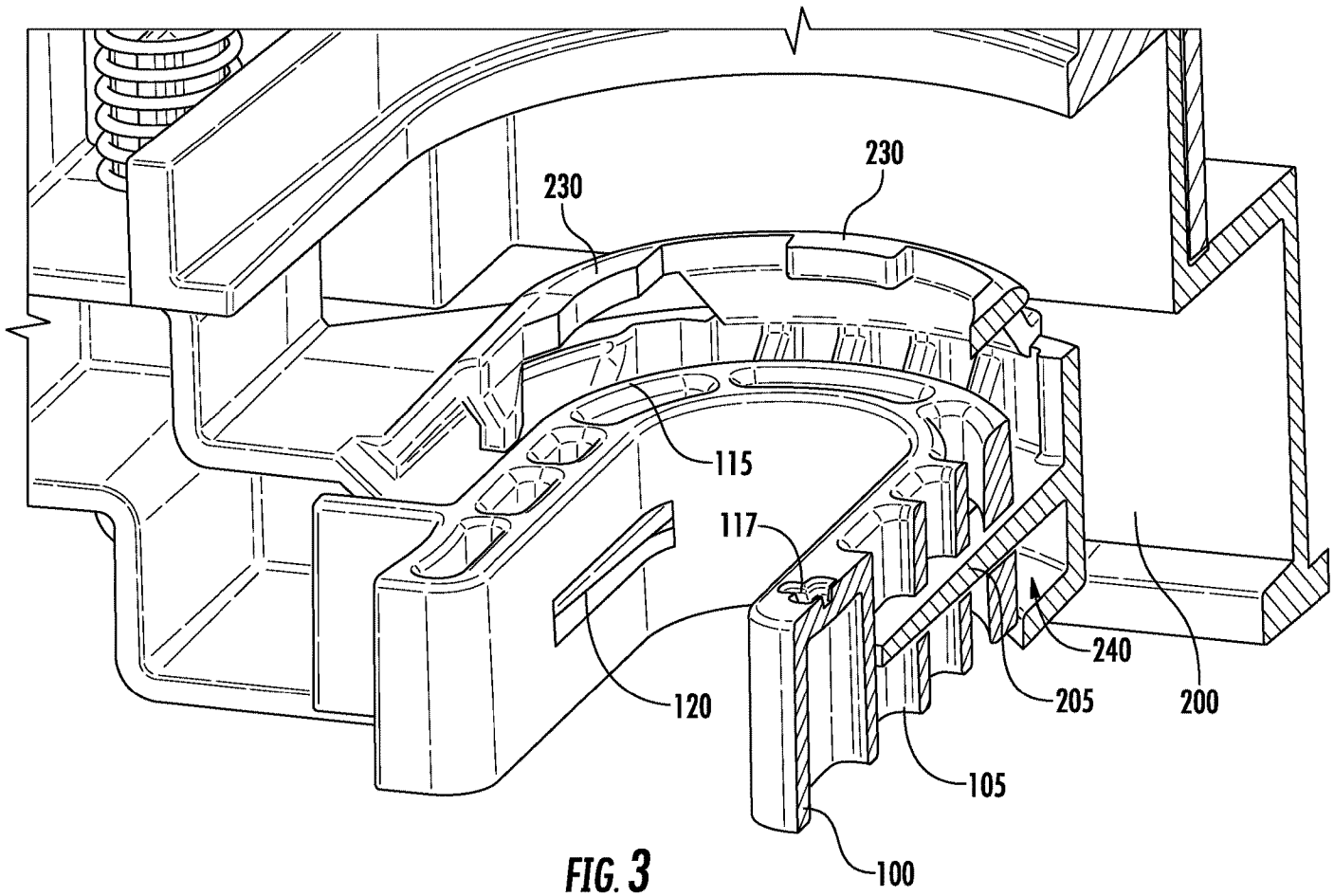

As shown in FIG. 3, when in the first orientation/position, the first surface 115 faces upwardly and is designed to engage the lower engagement surface 310 of the pump nozzle to cause the pump to begin the meaningful pump stroke. In contrast, as shown in FIG. 7, when the stroke adjuster 100 is oriented within the dispenser 1000 in the second orientation/position, the second surface 105 faces upwardly. In this orientation/position, a housing engagement surface 205 of the dispenser housing 200 is designed to engage the lower engagement surface 310 of the pump nozzle to cause the pump to begin the meaningful pump stroke. In particular, engagement of the lower pump engagement surface 310 with the first surface 115 (when in the first orientation/position, FIG. 4) begins at an earlier point in the full pump stroke than engagement of the pump nozzle (e.g., the lower pump engagement surface 310) with the engagement surface 205 of the dispenser housing 200 (when in the second orientation/position, FIG. 7). Thus, when the stroke adjuster 100 is in the first orientation/position, a longer meaningful pump stroke is defined compared to when the stroke adjuster 100 is in the second orientation/position and more fluid or foam is dispensed upon each activation of the dispenser.

Returning to FIG. 2, the stroke adjuster 100 comprises a first surface 115 and a second surface 105. The first surface 115 generally defines a first plane and the second surface 105 generally defines a second plane. In various embodiments, the first plane and the second plane are generally parallel. In example embodiments, the first surface 115 and/or the second surface 105 may comprise an orientation marker. For example, the first surface may comprise a first orientation marker 117. In an example embodiment, the second surface may comprise a second orientation marker 107. For example, when the first orientation marker 117 is pointing up, as shown in FIG. 4, the stroke adjuster 100 may be in the correct orientation to be positioned in the dispenser 1000 in the first orientation/position. In another example, when the second orientation marker 107 is pointing up, as shown in FIG. 7, the stroke adjuster 100 may be in the correct orientation to be positioned in the dispenser 1000 in the second orientation/position. Thus, the orientation marker(s) 107, 117 may be configured to provide maintenance personnel (e.g., individuals with access to the interior of the dispenser) a quick, visual, and/or palpable indicator of the orientation of the stroke adjuster 100. In another example, the orientation marker may be a portion indicator. For example, the orientation marker may be configured to indicate a relative amount of the fluid or foam that corresponds to whether the stroke adjuster is in the first orientation or in the second orientation. For example, in one embodiment, a first orientation marker 117 acting as a portion indicator may comprise a plus sign ("+") indicating that when the stroke adjuster 100 is oriented within a dispenser 1000 with the first surface positioned to be engaged by the lower pump surface 310, a larger portion of the primed fluid or foam will be dispensed. In another example, a second orientation marker acting as a portion indicator may comprise a minus sign ("−") indicating that when the stroke adjuster is oriented within a dispenser 1000 with the second surface facing upward toward the lower pump engagement surface 310, a smaller portion of the primed fluid or foam will be dispensed. In other embodiments, other orientation markers may be used. For example, in one embodiment, the first orientation marker 117 may be a graphical representation of two droplets and the second orientation marker 107 may be a graphical representation of one droplet. In another example, in one embodiment, the first orientation marker 117 may be a graphical representation of a droplet and the second orientation marker 107 may be a graphical representation of a portion of a droplet.

In the illustrated example embodiments, a cross-section of the stroke adjuster 100 taken parallel to the first and/or second plane (e.g., defined by the first or second surface 115, 105) is generally U-shaped. For example, the cross-section of the stroke adjuster 100 taken parallel to the first and/or second plane may comprise a first arm and a second arm which curve in at one end of each arm to connect with the other arm. For example, each arm may have a free end and a curved, connection end that connects that arm to the other arm. In some embodiments, the stroke adjuster 100 may define a reflection symmetry axis that is centered between the two arms and that lies in a plane parallel to the first and/or second plane.

In various embodiments, the stroke adjuster 100, and/or at least a portion thereof, is configured to be positioned within an adjuster receiving area 240. For example, the stroke adjuster 100 may comprise a dispenser engagement protrusion 140 configured to be positioned within the adjuster receiving area 240. In various embodiments, the dispenser engagement protrusion 140 may be configured to be positioned within the adjuster receiving area 240 when the stroke adjuster 100 is oriented within the dispenser in the first orientation/position or in the second orientation/position. In various embodiments, the dispenser engagement protrusion 140 extends part way along each arm of the U-shaped cross-section. For example, in one embodiment, the dispenser engagement protrusion 140 causes at least a portion of the arms of the second surface 105 to be wider than then the corresponding portion of the arms of the first surface 115, as can be seen by comparing FIG. 4 and FIG. 7. In some embodiments, the dispenser engagement protrusion 140 extends around the curve connecting the two arms of the stroke adjuster 100. In another embodiment, the dispenser engagement protrusion 140 extends from a point along the arm that generally corresponds to the end of the curved portion of the arm and extends at least part way along the arm toward the free end of the arm. In various embodiments, the dispenser engagement protrusion 140 may extend toward the free end of the arm to a tab 130.

In various embodiments, a tab 130 may extend outwardly from at least one arm of the stroke adjuster 100. For example, the tab 130 may define a plane that is generally perpendicular to the first and/or second plane. In various embodiments, the tab 130 may serve a primarily aesthetic purpose. In another embodiment, one or more tabs 150 may provide an easy handle for maintenance personnel handling the stroke adjuster 100 and/or may be configured to prevent maintenance personnel from inserting the stroke adjuster 100 too far into the adjuster receiving area 240. For example, the one or more tabs 130 may be configured to aid maintenance personnel in properly installing the stroke adjuster 100 in the dispenser 1000 and/or to provide the stroke adjuster 100, when oriented/positioned within the housing 200 to have a particular aesthetic appearance.

In various embodiments, the stroke adjuster 100 may comprise one or more slots 120. The slot 120 may be configured for receiving at least a portion of the housing engagement surface 205 therein when the stroke adjuster 100 is oriented within the dispenser 1000 in the first orientation/position. For example, in embodiments wherein the stroke adjuster 100 has a generally U-shaped cross-section, an outer surface 150 may connect an outer edge of the first surface 115 to an outer edge of the second surface 105 and an inner surface 160 may connect an inner edge of the first surface 115 to an inner surface of the second surface 105. In some embodiments, the slot 120 provides an opening in the outer surface 150 of the stroke adjuster 100 for receiving the housing engagement surface 205. In some embodiments, the slot 120 provides openings in both the outer surface 150 and the inner surface 160 of the stroke adjuster 100 for receiving the housing engagement surface 205. In various embodiments, the housing engagement surface 205 is parallel to the first and/or second plane (defined by the first surface 115 or the second surface 105) when the stroke adjuster 100 is positioned within the dispenser 1000. In such embodiments, the slot 120 may define a plane that is also parallel to the first and/or second plane.

In various embodiments, the stroke adjuster 100 may be made of plastic or other rigid and lightweight material. In some embodiments, the stroke adjuster 100 may be at least partially hollow.

As previously noted, the stroke adjuster 100 may be oriented in the dispenser 1000 in either a first orientation/position (shown in FIGS. 4-6) or a second orientation/position (shown in FIGS. 7-9). In various embodiments, if the stroke adjuster is oriented in the dispenser 1000 in the first orientation/position, a larger volume of fluid or foam is provided to the user upon activation of the dispenser 1000 than when the stroke adjuster 100 is oriented in the dispenser 1000 in the second orientation/position. For example, in various embodiments, when the stroke adjuster 100 is oriented within the dispenser 1000 in the first orientation/position, the meaningful pump stroke is longer than when the stroke adjuster 100 is oriented in the dispenser 1000 in the second orientation/position. For example, in various embodiments, a larger percentage of the primed fluid or foam may be provided from the pump 300 to the user upon activation of the dispenser when the stroke adjuster 100 is oriented within the dispenser 1000 in the first orientation/position than when the stroke adjuster is oriented within the dispenser 1000 in the second orientation/position.

In various embodiments, the stroke adjuster 100 may be switched between the first and second orientations/positions after the used fluid reservoir 400 and pump 300 have been removed from the dispenser 1000 and before a replacement fluid reservoir 400 and pump 300 are positioned within the dispenser. In various embodiments, the stroke adjuster 100 may be only be removed from either the first or second orientation/position when the pump 300 and fluid reservoir 400 are not positioned within the dispenser 1000.

When the Stroke Adjuster is Oriented in the First Orientation/Position within the Dispenser FIGS. 3-6 illustrate a stroke adjuster 100 oriented within the dispenser housing 200 of the dispenser 1000 in a first orientation/position. In the first orientation/position, the first orientation marker 117 is pointing up and the first surface 115 faces the lower pump engagement surface 310. In example embodiments, when in the first orientation/position within the dispenser 1000, the housing engagement surface(s) 205 are received within the slot(s) 120, and the dispenser engagement protrusion 140 is positioned within the adjuster receiving area 240.

As shown in FIG. 5, when a pump is positioned within the pump housing 450, the pump nozzle 315 is positioned below the dispenser flanges 230 such that the dispenser flanges 230 engage the upper pump engagement surface 305 when the springs 470 cause the housing 200 to return to the starting position of the full pump stroke. Thus, before the dispenser is activated to provide fluid or foam to a user, the upper pump engagement surface 305 is adjacent the dispenser flanges 230 and the pump is fully primed.

A user may then approach the dispenser and activate the dispenser to receive fluid or foam therefrom. As described above, the user may wave his or her hand in front of a motion detector, press a lever or button, or otherwise activate the dispenser. Activation of the dispenser causes the housing 200 to move upward. The housing 200 and the stroke adjuster 100 move upward until the first engagement surface 115 engages the lower pump engagement surface 310. When the lower pump engagement surface 310 is engaged by the first surface 115, the meaningful pump stroke is initiated. The housing 200 and the stroke adjuster 100 continue to move upward, causing an inner piston of the pump 300 to move upward into an outer piston of the pump, thereby forcing fluid or foam out of the pump. The fluid or foam is thereby provided to the user.

When the pump 300 reaches the ending point of the meaningful pump stroke (which is also the ending point of the full pump stroke), shown in FIG. 6, a first volume of fluid or foam has been pushed out of the pump 300 and provided to the user. In various embodiments, the first volume of fluid or foam may be approximately all of the primed fluid or foam within the pump 300 prior to the activation. In some embodiments, the first volume of fluid or foam may be most or more than half of the primed fluid or foam within the pump 300 prior to the activation. In particular, the fraction of primed fluid or foam within the pump 300 that is provided to the user upon activation of the dispenser is determined by the portion of the full pump stroke that occurs after the lower pump engagement surface 310 is engaged by the first surface 115. In other words, the fraction of the primed fluid or foam that is provided to the user upon activation of the dispenser is determined by the length of the meaningful pump stroke.

When the Stroke Adjuster is Oriented in the Second Orientation/Position within the Dispenser FIGS. 7-9 illustrate a stroke adjuster 100 oriented within the dispenser housing 200 of the dispenser 1000 in a second orientation/position. In the second orientation/position, the second orientation marker 107 is pointing up and the second surface 105 faces the lower pump engagement surface 310. For example, in the second orientation/position, the second surface 105 faces upward. In example embodiments, when in the second orientation/position within the dispenser 1000, the second surface 105 is positioned below housing engagement surface(s) 205. In various embodiments, when the stroke adjuster 100 is oriented within the dispenser 1000 in the second orientation/position, the housing engagement surface 205 is positioned between the second surface 105 and the lower pump engagement surface 310. In example embodiments, the dispenser engagement protrusion 140 is positioned within the adjuster receiving area 240 when the stroke adjuster 100 is in the second orientation/position within the dispenser 1000.

As shown in FIG. 8, when a pump is positioned within the pump housing 450, the pump nozzle 315 is positioned below the dispenser flanges 230 such that the dispenser flanges 230 engage the upper pump engagement surface 305 to cause the pump nozzle 315, the upper pump engagement surface 305, and the lower pump engagement surface 310 to move downward as springs 470 cause the housing 200 to return to the starting position of the full pump stroke. Thus, before the dispenser is activated to provide fluid or foam to a user, the upper pump engagement surface 305 is adjacent the dispenser flanges 230 and the pump is fully primed. As the position of the dispenser flanges 230 relative to the pump housing 450 does not change when the stroke adjuster 100 is switched between the first and second orientations/positions, the amount of fluid or foam with which the pump 300 is primed is independent of the orientation/position of the stroke adjuster 100 within the dispenser 1000. It should be noted that the difference between FIG. 5 and FIG. 8 is merely the orientation/position of the stroke adjuster 100 itself.

A user may then approach the dispenser and activate the dispenser to receive fluid or foam therefrom. As described above, the user may wave his or her hand in front of a motion detector, press a lever or button, or otherwise activate the dispenser. Activation of the dispenser causes the housing 200 to move upward. The housing 200 and the stroke adjuster 100 move upward until the housing engagement surface 205 engages the lower pump engagement surface 310. When the lower pump engagement surface 310 is engaged by the housing engagement surface 205, the meaningful pump stroke is initiated. The housing 200 and the stroke adjuster 100 continue to move upward, causing an inner piston of the pump 300 to move upward into an outer piston of the pump, thereby forcing fluid or foam out of the pump. The fluid or foam is thereby provided to the user.

When the pump 300 reaches the ending point of the meaningful pump stroke (which is also the ending point of the full pump stroke), shown in FIG. 9, a second volume of fluid or foam has been pushed out of the pump 300 and provided to the user. In various embodiments, the second volume of fluid or foam may be less than 100% of the primed fluid or foam within the pump 300 prior to the activation. In particular, the fraction of primed fluid or foam within the pump 300 that is provided to the user upon activation of the dispenser is determined by the portion of the full pump stroke that occurs after the lower pump engagement surface 310 engages the housing engagement surface 205. In various embodiments, the second volume of fluid or foam is smaller than the first volume of fluid or foam. For example, a smaller percentage of the primed fluid or foam within the pump 300 is provided to the user when the stroke adjuster 100 is in the second orientation/position compared to when the stroke adjuster 100 is in the first orientation/position. It should be noted that, in various embodiments, when the stroke adjuster 100 is oriented within the dispenser 1000 in the second orientation/position the portion of the full pump stroke that occurs before the meaningful pump stroke is initiated is longer than when the stroke adjuster 100 is oriented within the dispenser 1000 in the first position. In other words, as can be seen by comparing FIGS. 6 and 9, the meaningful pump stroke is longer and/or a larger fraction of the full pump stroke when the stroke adjuster 100 is oriented within the dispenser 1000 in the first orientation/position compared to when the stroke adjuster 100 is oriented within the dispenser 1000 in the second orientation/position.

When the Stroke Adjuster is not Positioned within the Dispenser

When the stroke adjuster 100 is oriented within the dispenser 1000 in the second orientation/position, the engagement of the lower pump engagement surface 310 with the housing engagement surface 205 causes the fluid or foam to be pushed out of the pump and provided to the user. Similarly, if the stroke adjuster 100 is not positioned within the dispenser 1000 and the dispenser is activated, the lower pump engagement surface 310 will engage the housing engagement surface 205 and dispense fluid or foam to the user as if the stroke adjuster 100 were oriented within the dispenser in the second orientation/position. Thus, a dispenser 1000 that does not have a stroke adjuster 100 positioned therein is as functional/operational as the dispenser 1000 would be if a stroke adjuster 100 were oriented within the dispenser 1000 in the second orientation/position.

For example, if a stroke adjuster 100 is not positioned within the dispenser 1000, when at the starting point of the full pump stroke, the pump nozzle 315 is positioned below the dispenser flanges 230 such that the dispenser flanges 230 engage and/or are adjacent to the upper pump engagement surface 305. The engagement of the dispenser flanges 230 by the upper pump engagement surface 305 causes the pump nozzle 315, the upper pump engagement surface 305, and the lower pump engagement surface 310 to move downward with the housing 200 as the springs 470 cause the housing 200 to return to the starting position of the full pump stroke. Thus, before the dispenser is activated to provide fluid or foam to a user, the upper pump engagement surface 305 is adjacent the dispenser flanges 230 and the pump is fully primed. The amount of fluid or foam with which the pump 300 is primed is when the stroke adjuster 100 is not positioned within the dispenser 1000 is the same amount with which the pump 300 is primed when the stroke adjuster 100 is oriented within the dispenser in either the first or second orientations.

A user may then approach the dispenser and activate the dispenser to receive fluid or foam therefrom. As described above, the user may wave his or her hand in front of a motion detector, press a lever or button, or otherwise activate the dispenser. Activation of the dispenser causes the housing 200 to move upward. The housing 200 and the stroke adjuster 100 move upward until the housing engagement surface 205 engages the lower pump engagement surface 310. When the lower pump engagement surface 310 is engaged by the housing engagement surface 205, the meaningful pump stroke is initiated. The housing 200 and the stroke adjuster 100 continue upward, causing an inner piston of the pump 300 to move upward into an outer piston of the pump, thereby forcing fluid or foam out of the pump. The fluid or foam is thereby provided to the user.

When the pump 300 reaches the ending point of the meaningful pump stroke (which is also the ending point of the full pump stroke), a second volume of fluid or foam has been pushed out of the pump 300 and provided to the user. Thus, if the stroke adjuster 100 is not positioned within the dispenser 1000, the dispenser continues to be operable as if the stroke adjuster were oriented within the dispenser in the second orientation. Therefore, if the stroke adjuster 100 is misplaced or removed from the dispenser 1000 for any reason, the dispenser maintains its functionality and is still able to provide fluid or foam to a user.

CONCLUSION

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A dispenser configured to dispense a fluid or foam, the dispenser comprising:

a housing configured to receive a fluid reservoir and a pump therein, wherein the pump is configured to dispense the fluid or foam from the fluid reservoir, wherein the housing comprises at least one housing engagement surface and defines an adjuster receiving area; and a stroke adjuster having a first surface and a second surface, said first surface defining a first plane and said second surface defining a second plane, said first plane being parallel or near parallel to said second plane, wherein the adjuster receiving area is configured to receive the stroke adjuster in one of either a first orientation or a second orientation, and wherein, when the stroke adjuster is oriented within the dispenser in the first orientation, the first surface is oriented upward and, when the dispenser is activated, a lower pump engagement surface of the pump is engaged by the first surface of the stroke adjuster, and wherein, when the stroke adjuster is oriented within the dispenser in the second orientation, the second surface is oriented upward and, when the dispenser is activated, the lower pump engagement surface is engaged by the housing engagement surface.

2. The dispenser of claim 1 wherein, if the stroke adjuster is either not positioned within the dispenser or positioned within the dispenser in the second orientation, the housing engagement surface is configured to engage the lower pump engagement surface.

3. The dispenser of claim 1, wherein a cross-section of the stroke adjuster parallel to the first plane is generally U-shaped.

4. The dispenser of claim 1, wherein, when the stroke adjuster is in the first orientation, a meaningful pump stroke is longer than when the stroke adjuster is in the second orientation and a starting point of a full pump stroke is the same regardless of whether the stroke adjuster is in the first orientation or the second orientation.

5. The dispenser of claim 1, wherein, when the stroke adjuster is oriented within the dispenser in the first orientation, a meaningful pump stroke begins when the first surface of the stroke adjuster engages the lower pump engagement surface.

6. The dispenser of claim 1, wherein, when the stroke adjuster is oriented within the dispenser in the second orientation, a meaningful pump stroke begins when the housing engagement surface engages the lower pump engagement surface.

7. The dispenser of claim 1, wherein the stroke adjuster further comprises a dispenser engagement protrusion and the adjuster receiving area is configured to receive the dispenser engagement protrusion therein.

8. The dispenser of claim 1, wherein the stroke adjuster comprises at least one slot configured to receive the housing engagement surface therein when the stroke adjuster is in the first orientation, and wherein, when the stroke adjuster is in the second orientation, the housing engagement surface is positioned between the stroke adjuster and the pump engagement surface.

9. The dispenser of claim 1, wherein the housing and the stroke adjuster are configured such that after each activation of the dispenser, the pump is primed with the same amount of fluid or foam regardless of whether the stroke adjuster is in the first orientation or the second orientation.

10. The dispenser of claim 1, wherein, when the stroke adjuster is oriented within the dispenser in either the first orientation or second orientation, the dispenser housing engagement surface is generally parallel to the first plane.

11. The dispenser of claim 1, wherein each of the first surface and the second surface comprise an orientation marker configured to indicate a relative amount of the fluid or foam that corresponds to whether the stroke adjuster is in the first orientation or in the second orientation.

12. The dispenser of claim 1, wherein, when the stroke adjuster is in the first orientation, the dispenser dispenses a larger volume of fluid or foam upon each activation than when the stroke adjuster is in the second orientation.

13. The dispenser of claim 1, wherein the stroke adjuster comprises tabs that extend generally outward from the arms of a U-shaped cross-section and that are generally perpendicular to the first plane, wherein the U-shaped cross-section is parallel to the first plane.

14. The dispenser of claim 1, wherein, when the stroke adjuster is oriented in the dispenser in the first orientation, the stroke adjuster is positioned within the dispenser in a first position and when the stroke adjuster is oriented in the dispenser in the second orientation, the stroke adjuster is positioned within the dispenser in a second position.

15. A stroke adjuster comprising:

a body defining a first surface and a second surface, the first surface defining a first plane and the second surface defining a second plane, said first plane being parallel or near parallel to said second plane, wherein the stroke adjuster is configured to be oriented within a dispenser in one of either a first orientation or a second orientation, wherein, when the stroke adjuster is oriented within the dispenser in the first orientation, the first surface is positioned upward and, when the dispenser is activated, a lower pump engagement surface of a pump positioned within the dispenser is engaged by the first surface of the stroke adjuster, and wherein, when the stroke adjuster is oriented within the dispenser in the second orientation, the second surface is positioned upward and, when the dispenser is activated, the lower pump engagement surface is not engaged by the stroke adjuster.

16. The stroke adjuster of claim 15, wherein a cross-section of the body parallel to the first plane is generally U-shaped.

17. The stroke adjuster of claim 15, wherein a meaningful pump stroke of the pump is longer when the stroke adjuster is oriented within the dispenser in the first orientation than when the stroke adjuster is oriented within the dispenser in the second orientation, and wherein a starting point of a full pump stroke of the pump is the same regardless of whether the stroke adjuster is in the first orientation or the second orientation within the dispenser.

18. The stroke adjuster of claim 15, wherein the stroke adjuster further comprises at least one tab that extends generally outward from an arm of a U-shaped cross-section of the body, wherein the at least one tab is generally perpendicular to the first plane, wherein the U-shaped cross-section is a cross-section of the body taken parallel to the first plane.

19. The stroke adjuster of claim 15 further comprising at least one slot configured to receive a housing engagement surface of the dispenser when the stroke adjuster is in the first orientation within the dispenser, and wherein, when the stroke adjuster is in the second orientation within the dispenser, the housing engagement surface is positioned between the stroke adjuster and the pump engagement surface.

20. The stroke adjuster of claim 19, wherein the at least one slot defines a plane that is generally parallel to the first plane.

21. The stroke adjuster of claim 15, wherein each of the first surface and the second surface comprise an orientation marker configured to indicate a relative amount of the fluid or foam to be dispensed from the dispenser that corresponds to whether the stroke adjuster is in the first orientation or in the second orientation.

22. The stroke adjuster of claim 15, wherein the dispenser dispenses a larger volume of fluid or foam upon each activation when the stroke adjuster is oriented within the dispenser in the first orientation than when the stroke adjuster is oriented within the dispenser in the second orientation.

* * * * *